US010384891B2

(12) United States Patent
Furuichi et al.

(10) Patent No.: US 10,384,891 B2
(45) Date of Patent: Aug. 20, 2019

(54) PAPER FEED APPARATUS AND PAPER FEED UNIT

(71) Applicant: Konica Minolta, Inc., Tokyo (JP)

(72) Inventors: Wataru Furuichi, Hino (JP); Kazuyoshi Kimura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/803,114

(22) Filed: Nov. 3, 2017

(65) Prior Publication Data

US 2018/0150006 A1 May 31, 2018

(30) Foreign Application Priority Data

Nov. 30, 2016 (JP) ..... 2016-232003

(51) Int. Cl.

| | |
|---|---|
| ***B65H 3/48*** | (2006.01) |
| ***B65H 3/04*** | (2006.01) |
| ***B65H 1/26*** | (2006.01) |
| ***G03G 15/00*** | (2006.01) |
| ***B65H 1/04*** | (2006.01) |

(Continued)

(52) U.S. Cl.

CPC ..... *B65H 3/48* (2013.01); *B65H 1/04* (2013.01); *B65H 1/14* (2013.01); *B65H 1/26* (2013.01); *B65H 3/04* (2013.01); *B65H 3/128* (2013.01); *G03G 15/6511* (2013.01); *B65H 2405/112* (2013.01); *B65H 2405/11161* (2013.01); *B65H 2405/15* (2013.01); *B65H 2405/332* (2013.01);

(Continued)

(58) Field of Classification Search

CPC .. B65H 3/48; B65H 13/00; B65H 2405/1112; B65H 2405/1116; B65H 2405/11161; B65H 2405/11162; B65H 2405/11163; B65H 2405/351; B65H 2405/36

See application file for complete search history.

(56) References Cited

U.S. PATENT DOCUMENTS 5,277,418 A * 1/1994 Jones ..... B65H 1/04 271/145
6,460,846 B2 * 10/2002 Yow ..... B65H 1/14 271/155

(Continued)

FOREIGN PATENT DOCUMENTS

JP 58-220032 A 12/1983
JP 61-254438 A 11/1986

(Continued)

*Primary Examiner* — Patrick Cicchino
(74) *Attorney, Agent, or Firm* — Lucas & Mercanti, LLP

(57) ABSTRACT

A paper feed apparatus includes: a sheet tray on which sheets are stacked; a sheet attractor which is located above the sheet tray and attracts sheets one by one from the above; a leading edge fan which is located in a leading edge side of the sheets and blows separation air against leading edges of the sheets to separate an uppermost sheet of the sheets closest to the sheet attractor from lower sheets located below the uppermost sheet; a sheet conveyor which is located in a downstream side of the sheet attractor along a conveying direction of the sheets to convey the uppermost sheet which is attracted by the sheet attractor and separated from the lower sheets by the leading edge fan; and a lifting member which is detachably provided on the sheet tray to support a tail side of a back of the sheets.

13 Claims, 13 Drawing Sheets

(51) Int. Cl.
*B65H 1/14* (2006.01)
*B65H 3/12* (2006.01)

(52) U.S. Cl.
CPC .... *B65H 2511/20* (2013.01); *B65H 2515/212* (2013.01)

(56) References Cited

U.S. PATENT DOCUMENTS

| | | | | |
|---|---|---|---|---|
| 8,191,891 | B2 * | 6/2012 | Yamagata | B65H 1/266 271/148 |
| 8,246,040 | B2 * | 8/2012 | Suzuki | B65H 1/14 271/152 |
| 8,348,259 | B2 * | 1/2013 | Marasco | B65H 1/14 271/148 |
| 8,439,349 | B2 * | 5/2013 | Matsumoto | B65H 3/128 271/108 |
| 8,827,262 | B2 * | 9/2014 | Itabashi | B65H 1/266 271/148 |
| 9,193,544 | B2 * | 11/2015 | Nakagawa | B65H 1/266 |
| 9,340,384 | B2 * | 5/2016 | Yabuki | B65H 3/128 |
| 10,040,648 | B2 * | 8/2018 | Takai | B65H 1/266 |
| 2016/0200530 | A1 * | 7/2016 | Kimura | B65H 1/14 271/2 |

FOREIGN PATENT DOCUMENTS

| | | | |
|---|---|---|---|
| JP | 61-254439 | A | 11/1986 |
| JP | 10-1231 | A | 1/1998 |
| JP | 2002002986 | A | 1/2002 |
| JP | 2005320084 | A | 11/2005 |
| JP | 2010195527 | A | 9/2010 |
| JP | 2011225290 | A | 11/2011 |

* cited by examiner

PAPER FEED APPARATUS AND PAPER FEED UNIT

Japanese Patent Application No. 2016-232003 filed on Nov. 30, 2016 including description, claims, drawings, and abstract the entire disclosure is incorporated herein by reference herein in its entirely.

BACKGROUND

Technological Field

The present invention generally relates to a paper feed apparatus and a paper feed unit.

Description of the Related Art

In the past, it has been proposed to extract, from among sheets stacked on a sheet tray, the uppermost sheet by separating the sheets with blowing air and attracting the uppermost sheet to a transfer belt having a number of through holes where negative pressure is generated (for example, refer to Japanese Unexamined Patent Application Publication No. 1983-220032).

Also, it has been proposed to attract an uppermost sheet with lifting air which lifts sheets stacked on a sheet tray and separating air which separates the uppermost sheet of the lifted sheets from lower sheets located below the uppermost sheet (for example, refer to Japanese Unexamined Patent Application Publication No. 2002-002986, Japanese Unexamined Patent Application Publication No. 2010-195527 and Japanese Unexamined Patent Application Publication No. 1986-254439).

Furthermore, it has been proposed to facilitate separation between an uppermost sheet and lower sheets by providing a protrusion or making part of an attraction surface of a conveyor belt protrude to generate a gap between the uppermost sheet and the lower sheets and supplying separating air into this gap (for example, refer to Japanese Unexamined Patent Application Publication No. 1986-254438 and Japanese Unexamined Patent Application Publication No. 2011-225290).

Incidentally, it has been also proposed to adjust the heights of the leading and tail edges of a sheet in accordance with curl of the sheet (for example, refer to Japanese Unexamined Patent Application Publication No. 1998-001231). Furthermore, as a technique to smoothly convey sheets in addition to the prior art technique described in Japanese Unexamined Patent Application Publication No. 1998-001231, it has been proposed to restrict horizontal motion of envelopes with a restriction member for extracting an uppermost envelope in a horizontal direction (for example, refer to Japanese Unexamined Patent Application Publication No. 2005-320084).

SUMMARY

However, in the case of the prior art techniques described in the aforementioned Japanese Unexamined Patent Application Publications, separating air may flow not only between the uppermost sheet and the lower sheets but also between the lower sheets to hinder separation of these sheets in a condition where these sheets are lifted. Particularly, in the case where the leading edge of a sheet is curled upward, there is a fear that separation of sheets is hindered.

Also, in the case of sheets whose stiffness is high, the sheets are not corrugated along an attraction surface of a conveyor belt so that separating air cannot easily enter between sheets. Also in this case, there is a fear that separation of sheets is hindered.

Furthermore, in the case of special sheets such as small-sized sheets, envelopes and so forth, like the above, separating air cannot easily enter between sheets so that there is a fear that separation of sheets is hindered.

Taking into consideration the above circumstances, it is an object of the present invention therefore to avoid failure in separating sheets even if there are an increased number of types of sheets to be fed.

To achieve at least one of the abovementioned objects, according to one aspect of the present invention, a paper feed apparatus comprises: a sheet tray on which sheets are stacked; a sheet attractor which is located above the sheet tray and attracts sheets one by one from the above; a leading edge fan which is located in a leading edge side of the sheets and blows separation air against leading edges of the sheets to separate an uppermost sheet of the sheets closest to the sheet attractor from lower sheets located below the uppermost sheet; a sheet conveyor which is located in a downstream side of the sheet attractor along a conveying direction of the sheets to convey the uppermost sheet which is attracted by the sheet attractor and separated from the lower sheets by the leading edge fan; and a lifting member which is detachably provided on the sheet tray to support a tail side of a back of the sheets.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

Figure 1:
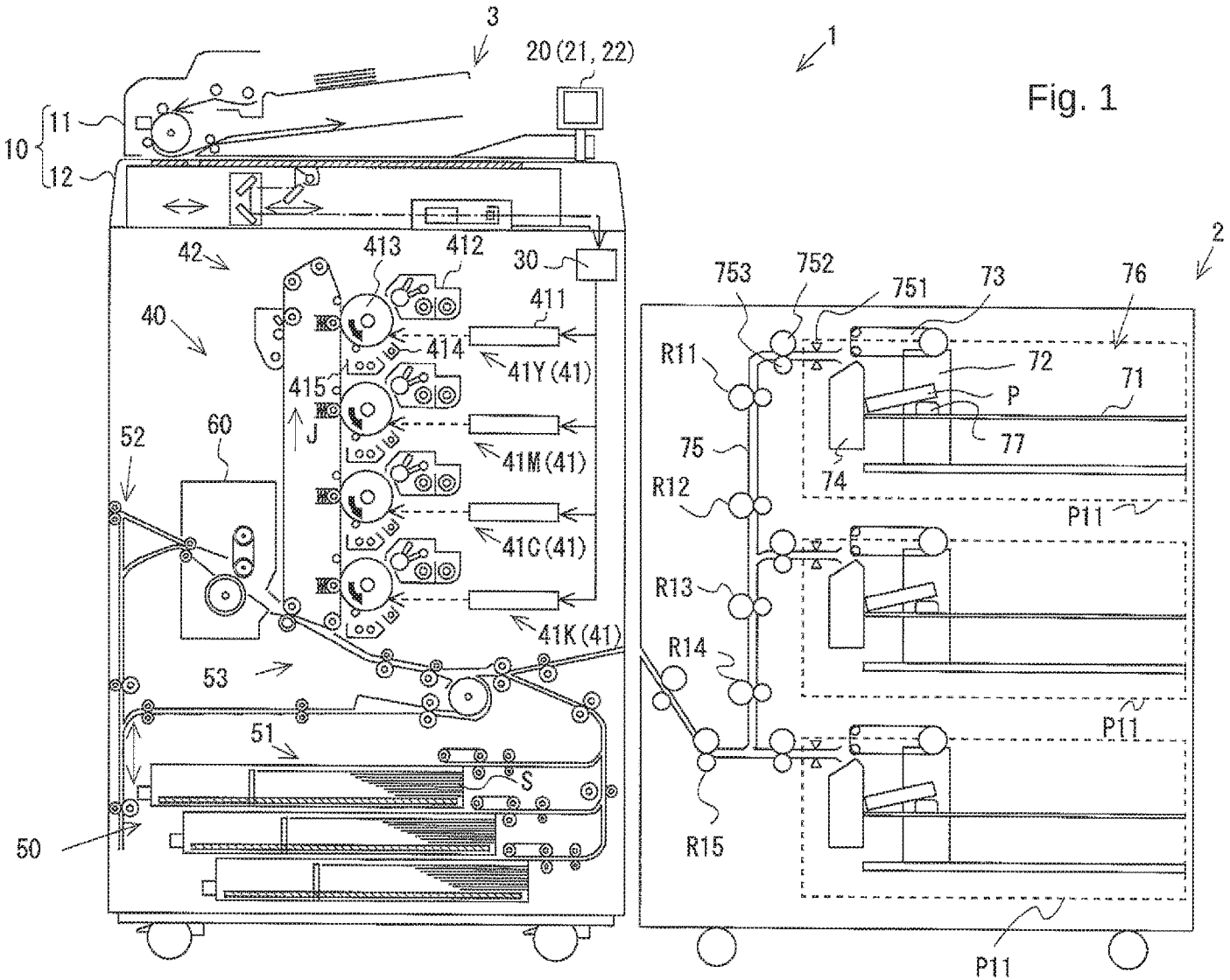
FIG. 1 is a schematic view for showing an example of the overall configuration of an image forming unit 1 in accordance with an embodiment 1 of the present invention.
Figure 2:
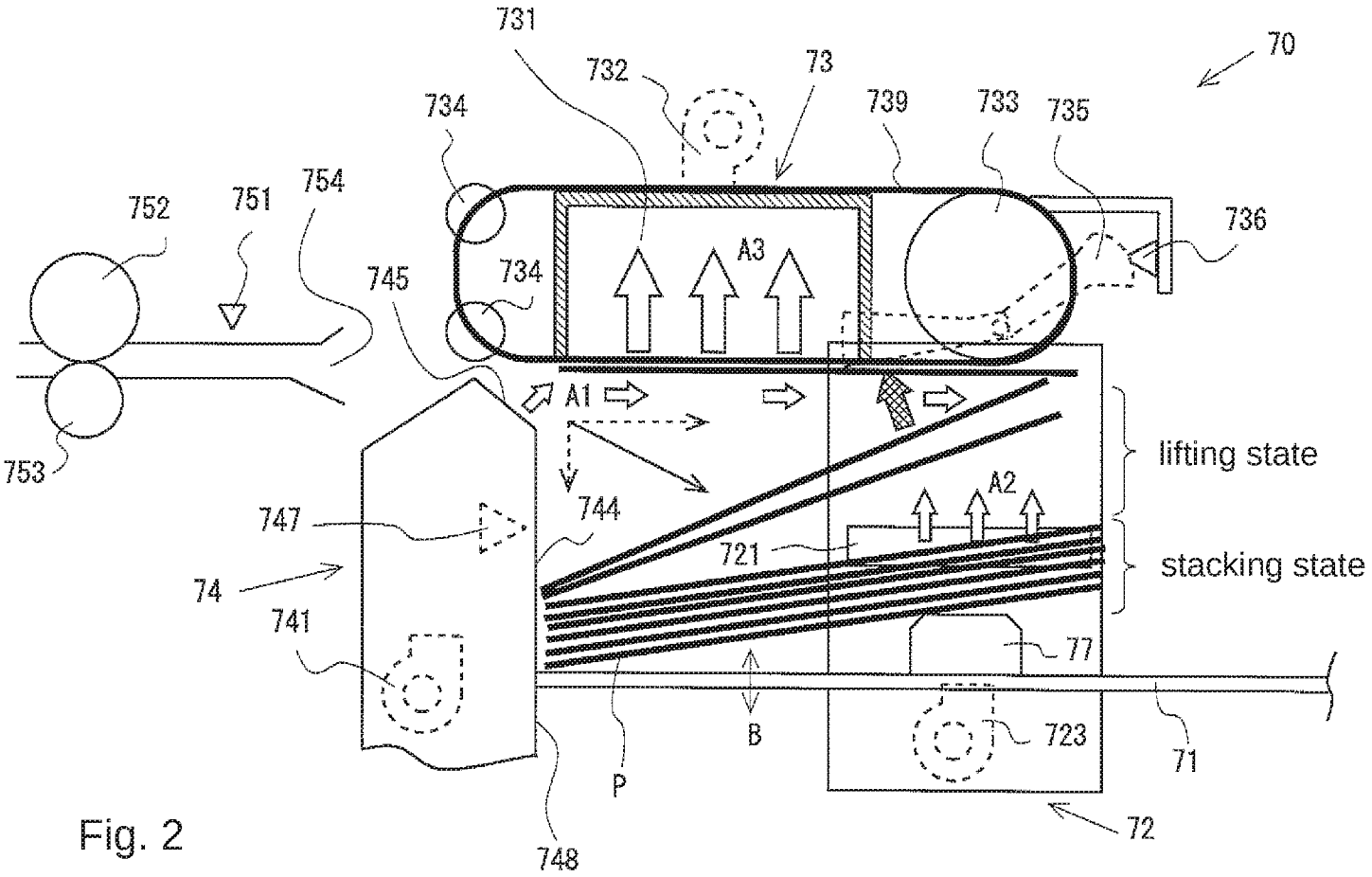
FIG. 2 is a view for showing an exemplary structure of a paper feed apparatus 70 in accordance with the embodiment 1 of the present invention.
Figure 3:
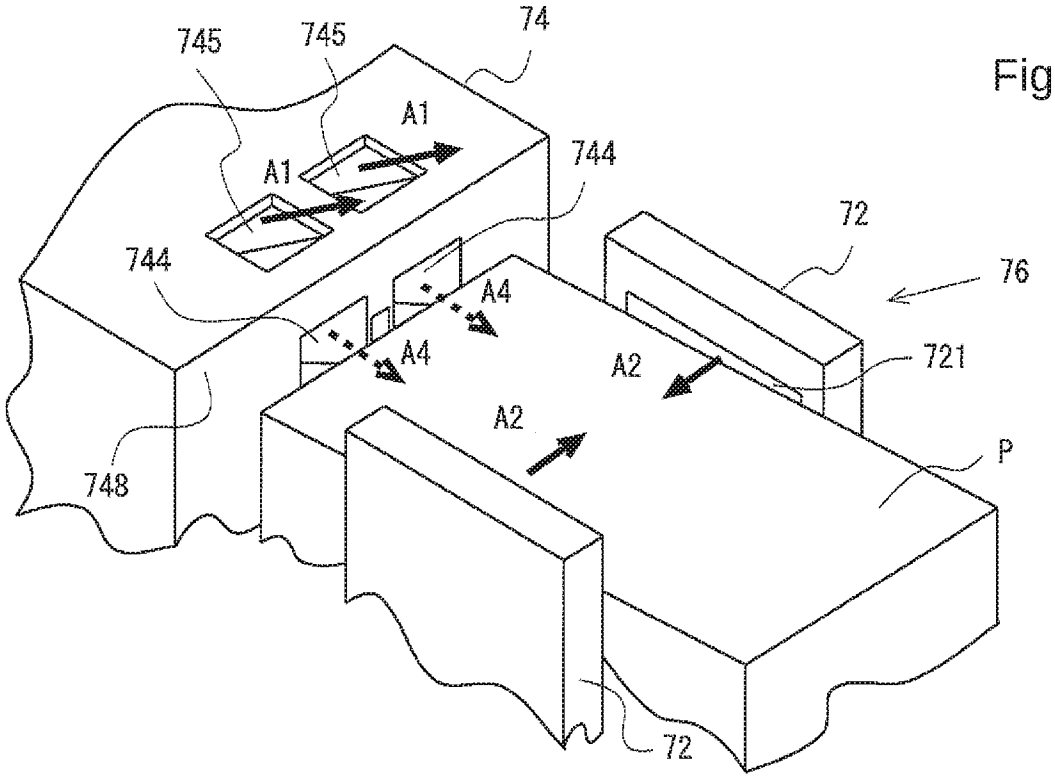
FIG. 3 is a view for showing an exemplary structure of a sheet storage unit 76 in accordance with the embodiment 1 of the present invention.

FIG. 1 is a schematic view for showing an example of the overall configuration of an image forming unit 1 in accordance with an embodiment 1 of the present invention. FIG. 2 is a view for showing an exemplary structure of a paper feed apparatus 70 in accordance with the embodiment 1 of the present invention. FIG. 3 is a view for showing an exemplary structure of a sheet storage unit 76 in accordance with the embodiment 1 of the present invention.

The image forming unit 1 includes a paper feed unit 2 and an image forming apparatus 3. In the image forming unit 1, when a sheet P is conveyed, the paper feed unit 2 is located in the upstream side of the image forming apparatus 3. The image forming apparatus 3 is an apparatus which forms a color image on a sheet P or a sheet S by an intermediate transfer system based on an electrophotographic process technique. The image forming apparatus 3 transfers toner images of respective colors, i.e., color Y (yellow), color M (Magenta), color C (cyan) and color K (black) formed on photoreceptor drums 413 to the intermediate transfer belt as a first transfer process. The respective color toner images transferred to the intermediate transfer belt are superimposed as four color images and transferred to a sheet P or a sheet S as a second transfer process to form an image on the sheet S. The image forming apparatus 3 is based on a tandem system. The tandem system is a system in which the photoreceptor drums 413 corresponding to the four colors YMCK are arranged in series in the running direction J of the intermediate transfer belt so that a toner image of each color is successively transferred to the intermediate transfer belt in one step.

Specifically, the image forming apparatus 3 is provided with an image reading unit 10, an operation display 20, an image processing unit 30, an image forming block 40, a paper conveying unit 50, a fixing unit 60 and a control unit which is not shown in the figure. The control unit is provided with a CPU, a ROM, a RAM, a storage unit and the like. The CPU reads a program from the ROM in accordance with a required process, loads the program into the RAM, and executes the loaded program to control the operation of the image forming apparatus 3 in cooperation. The storage unit consists of a nonvolatile semiconductor device such as a flash memory or the like or a hard disk drive for storing various data. The various data stored in the storage unit is referred to when the CPU controls the operation of the image forming apparatus 3. Incidentally, like the image forming apparatus 3, the paper feed unit 2 is provided with a control unit which controls the operation of the paper feed unit 2.

The operation display 20 is implemented with a liquid crystal display (LCD: Liquid Crystal Display) incorporating a touch panel, and serves as a display unit 21 and an operation unit 22. The display unit 21 displays a various operation screen, the condition of an image, the operation state of each function and the like in accordance with a display control signal which is input from the control unit. The operation unit 22 is provided with various operation keys such as a ten keyboard, a start key and so forth. The operation unit 22 accepts various input operations from a user and generates operation signals. The operation signals are output to the control unit. The image reading unit 10 is provided with an automatic page feeding unit 11 and an original image scanner device 12. The automatic page feeding unit 11 is called an ADF (Auto Document Feeder). The automatic page feeding unit 11 conveys originals, which are placed on an original tray, by a conveyance mechanism and transfers the originals to the original image scanner device 12. The automatic page feeding unit 11 can successively read a number of originals placed on the original tray. Meanwhile, when successively reading a number of originals, the automatic page feeding unit 11 can read the opposite sides of each original by a sheet reversing mechanism. The original image scanner device 12 optically scans an original conveyed to a contact glass from the automatic page feeding unit 11 or an original placed on the contact glass. The original image scanner device 12 reads an original image formed on an original by causing a reflected light from the original to form an image on a light receiving plane of a CCD sensor during optical scanning. The image reading unit 10 generates input image data of the original image based on the reading result of the original image scanner device 12. The input image data is supplied to the image processing unit 30 which performs a predetermined image process with the input image data.

The image processing unit 30 is provided with a circuit which performs a digital image process with the input image data in accordance with initial settings or user settings. The image processing unit 30 performs, for example, gradation level adjustment of the input image data under control of the control unit based on a gradation level adjustment table in which gradation level adjustment data is set up. In addition to the gradation level adjustment, the image processing unit 30 also performs other processes with the input image data such as color correction, shading compensation and other various correction processes, and compression processes. The image forming block 40 performs various processes with the input image data after performing such various digital image processes. The image formation block 40 forms an image based on the input image data with colored toners corresponding to a Y component, an M component, a C component and a K component respectively. The image forming block 40 is provided with image forming units 41Y, 41M, 41C and 41K, an intermediate transfer unit 42 and the like. The image forming units 41Y, 41M, 41C and 41K are composed of the same constituent elements except they forms images of different colors respectively. For the sake of clarity in explanation and illustration, while like numerals denote similar elements, suffixes Y, M, C and K is added to the ends of the numerals respectively for distinguishing from each other, but no suffix is added when they need not be distinguished. In the case of the example as shown in FIG. 1, only the constituent elements of the image forming unit 41Y for component Y are given reference numerals, but reference numerals are omitted for the constituent elements of the other image forming units 41M, 41C and 41K.

The image forming unit 41 is provided with an exposing device 411, a development apparatus 412, a photoreceptor drum 413, a charging unit 414, a drum cleaning unit 415 and the like. The charging unit 414 charges the photoreceptor drum 413 by corona discharge. The exposing device 411 irradiates the photoreceptor drum 413 with laser light corresponding to the image of each color component to form an electrostatic latent image corresponding to each color component. The development apparatus 412 forms a toner image by attaching a toner of each color component to the surface of the photoreceptor drum 413 to visualize an electrostatic latent image.

Incidentally, the drum cleaning unit 415 removes transfer residual toner which remains on the surface of the photoreceptor drum 413 after a first transfer process. The intermediate transfer unit 42 is provided with an intermediate transfer belt, a first transfer roller, a second transfer roller and the like. A first transfer nip portion is formed by urging the first transfer roller against the intermediate transfer belt, and serves to transfer a toner image from the photoreceptor drum 413 to the intermediate transfer belt. A toner image is transferred from the intermediate transfer belt to a sheet P or a sheet S through the second transfer nip formed between the intermediate transfer belt and the second transfer roller which are urged together. The fixing unit 60 forms an image on a sheet P or a sheet S by applying heat and pressure to the toner image transferred to the sheet P or the sheet S. The paper conveying unit 50 is provided with a paper feed unit 51, a discharging unit 52, a conveyance route unit 53 and the like. The paper feed unit 51 accommodates sheets S which are classified based on paper densities and sizes of sheets and separately stored in accordance with predetermined sheet types respectively. The conveyance route unit 53 is used to convey a sheet P supplied from the paper feed unit 2, a sheet S stored in the paper feed unit 51, or a sheet P or a sheet S with either a front or a back side on which an image is formed. Incidentally, the discharging unit 52 discharges outwards a sheet P or a sheet S on which an image is formed.

The paper feed unit 2 separates and discharges sheets P one by one. The sheet P discharged from the paper feed unit 2 is conveyed to the image forming apparatus 3. For example, the paper feed unit 2 is provided with three paper feed trays P11 including the sheet storage units 76 which are arranged in the vertical direction. A sheet attractor 73 is provided above each sheet storage unit 76. A pair of side guides 72 are provided in both sides of each sheet storage unit 76. The sheet tray 71 is provided between the pair of side guides 72. Sheets P are placed on the sheet tray 71.

Although described below in detail, the side guides 72 serve to hold sheets P placed on the sheet tray 71 in the width direction, and also serve to blow air to the sheets P as side air A2. By this configuration, the side guides 72 assist operation of attracting a sheet P to the sheet attractor 73 by an air blowing unit 74 and the sheet attractor 73. The air blowing unit 74 is located in the leading side of sheets P placed on the sheet tray 71. The air blowing unit 74 blows air to the sheets P as separation air A1. Incidentally, the air blowing unit 74 may also blow air to the sheets P as lifting air A4.

Although described below in detail, the sheet attractor 73 is arranged above the sheet tray 71 and attracts sheets P with a suction force one by one from the above. The sheet attractor 73 separates, for example, the first sheet P from sheets P placed on the sheet tray 71. The sheet attractor 73 conveys the separated first sheet P to a sheet conveyor 75. The sheet conveyor 75 is provided with sheet feed detection sensors 751, conveyance rollers 752, driven rollers 753 and conveyance rollers R11 to R15. The sheet feed detection sensor 751 is implemented, for example, with a photo sensor which consists of a light receiving device and a light emitting device. The sheet feed detection sensor 751 detects the position of a sheet P. While being held between the conveyance roller 752 and the driven roller 753, a sheet P is conveyed by the conveyance rollers R11 to R14 through the conveying guide 754 downward in the vertical direction, which adjusts in the conveying direction, and guided in the direction toward the conveyance roller R15. The conveyance roller R15 serves as a paper stop roller which adjusts timing, when a sheet P is conveyed to the image forming apparatus 3, with the image formation process of the image forming apparatus 3.

The paper feed apparatus 70 is provided with the side guides 72, the sheet attractor 73 and the air blowing unit 74. The paper feed apparatus 70 attracts a sheet P to the sheet attractor 73 by exerting the side air A2 blown from the side guides 72 and the separation air A1 blown from the air blowing unit 74. The sheet attractor 73 supplies the attracted sheet P to the conveying guide 754. The conveying guide 754 is located between the upstream side of the conveyance roller 752 and the downstream side of the sheet attractor 73 as a member which guides a sheet P conveyed from the sheet attractor 73 to the conveyance roller 752.

In what follows, the paper feed apparatus 70 will be specifically explained. The sheet tray 71 can be freely elevated and lowered by an elevating/lowering unit (not shown) in the lifting and lowering direction B along the stacking direction of sheets P. The air blowing unit 74 is provided with an abutting surface 748 on which the leading edges of sheets P abut along the vertical direction. The leading edge positions of sheets P placed on the sheet tray 71 are maintained by the abutting surface 748 formed on the air blowing unit 74. Accordingly, the sheet storage unit 76 can be freely elevated and lowered along the abutting surface 748. An upper limit detection sensor 747 is provided in the air blowing unit 74 as a means for determining the height of the sheet tray 71. The upper limit detection sensor 747 is located at such a height as to detect the area in which the sheet attractor 73 can attract a sheet P. The upper limit detection sensor 747 is implemented, for example, with a photo sensor which consists of a light receiving device and a light emitting device to detect the upper surface position of sheets P placed on the sheet tray 71. For example, when it is determined from the detection result of the upper limit detection sensor 747 that the upper surface position of sheets P placed on the sheet tray 71 is not within the area in which the sheet attractor 73 can attract a sheet P, the sheet tray 71 is elevated to the area in which the sheet attractor 73 can attract a sheet P.

The side guide 72 is provided with a side air opening 721, a side fan 723 and the like. The side air opening 721 is formed in a position opposite to the side edges of sheets P placed on the sheet tray 71. For example, the side fan 723 is a device such as a blower which can supply air. The air supplied by the side fan 723 is ejected through the side air opening 721 as side air A2. The side air A2 ejected through the side air opening 721 blows approximately in a horizontal direction against the lateral side of sheets P.

The air blowing unit 74 is provided with a leading edge fan 741, a lifting air outlet 744, a separating air outlet 745 and the like. For example, the leading edge fan 741 is a device such as a blower which can supply air. The leading edge fan 741 is located in the leading edge side of sheets P and blows the separation air A1 against the leading edges of the sheets P to separate the uppermost sheet of the sheets P closest to the sheet attractor 73 from lower sheets located below the uppermost sheet. The lifting air outlet 744 is formed in a position opposite to sheets P placed on the sheet tray 71. The separating air outlet 745 is formed in a position toward the sheet attractor 73.

The sheet attractor 73 is provided with an attraction chamber 731, an attraction fan 732, a drive roller 733, driven rollers 734, a detection member 735, an attraction detection sensor 736, a conveyor belt 739 and the like. The attraction chamber 731 is located in the inner side of the conveyor belt 739. The attraction fan 732 is provided on a ventilation port which is not shown in the figure but located in the ceiling side of the attraction chamber 731. When the attraction fan 732 draws air from the attraction chamber 731, attraction air A3 flows and generates a negative pressure inside the attraction chamber 731. Namely, the attraction fan 732 provides a negative pressure in the sheet attractor 73. The conveyor belt 739 is wound around the drive roller 733 and the driven rollers 734 with tension applied to the conveyor belt 739. The drive roller 733 is driven to rotate. The driven rollers 734 rotate by following the conveyor belt 739 which rotates by the drive roller 733 which is rotationally driven. Accordingly, the conveyor belt 739 conveys a sheet P which is given a negative pressure by the attraction fan 732. The drive roller 733 controls conveyance of a sheet P through the conveyor belt 739.

Incidentally, based on the detection result of the attraction detection sensor 736, it is determined whether or not a sheet P is attracted onto the conveyor belt 739. Specifically, the attraction detection sensor 736 detects a change in the position of the detection member 735. Namely, if at least the uppermost sheet which is located in the uppermost position of sheets P is attracted onto the conveyor belt 739 by the attraction fan 732, the position of the detection member 735 is changed so that the attraction detection sensor 736 can detect the uppermost sheet attracted onto the conveyor belt 739. On the other hand, the conveying position of a sheet P is determined based on the detection result of the sheet feed detection sensor 751. When the sheet feed detection sensor 751 detects the leading edge of a sheet P, the conveyance roller 752 is rotationally driven to convey the sheet P in cooperation with the driven rollers 753. When the sheet feed detection sensor 751 detects the tail edge of a sheet P, it is determined that a first sheet P has been conveyed to the conveyance unit 75 by the sheet attractor 73. When it is determined that a first sheet P has been conveyed to the conveyance unit 75, control is performed to convey a second sheet P to the conveyance unit 75.

The paper feed apparatus 70 is provided with a lifting member 77. The lifting member 77 is detachably provided on the sheet tray 71 to support the tail side of the back of sheets P. Incidentally, the attraction force of the attraction fan 732 is set to be stronger than the separation force of the leading edge fan 741 for separating lower sheets from an uppermost sheet at least until the uppermost sheet is attracted by the sheet attractor 73. The blowing direction of the separation air A1 is controlled in the same direction from the start of conveying a sheet P until the end. The blowing quantity of the separation air A1 is determined based on the type and size of a sheet P. The leading edge fan 741 continuously blows the separation air A1 while a sheet P is conveyed from the sheet tray 71 to the conveyance unit 75.

Figure 13:
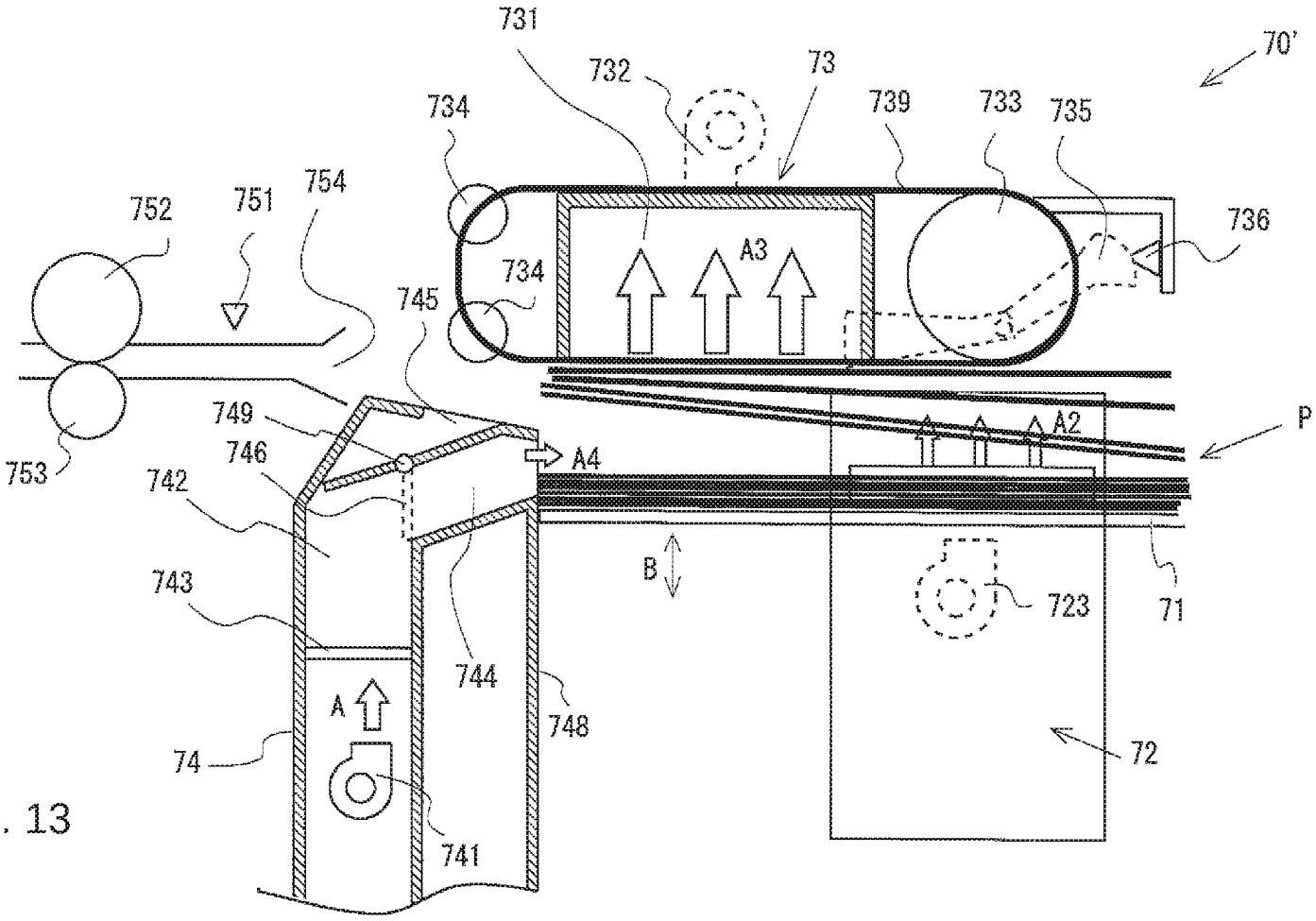
FIG. 13 is a side view for showing an example of operation when lifting air A4 is blown against the leading edges of sheets P in a conventional paper feed apparatus 70'.
Figure 14:
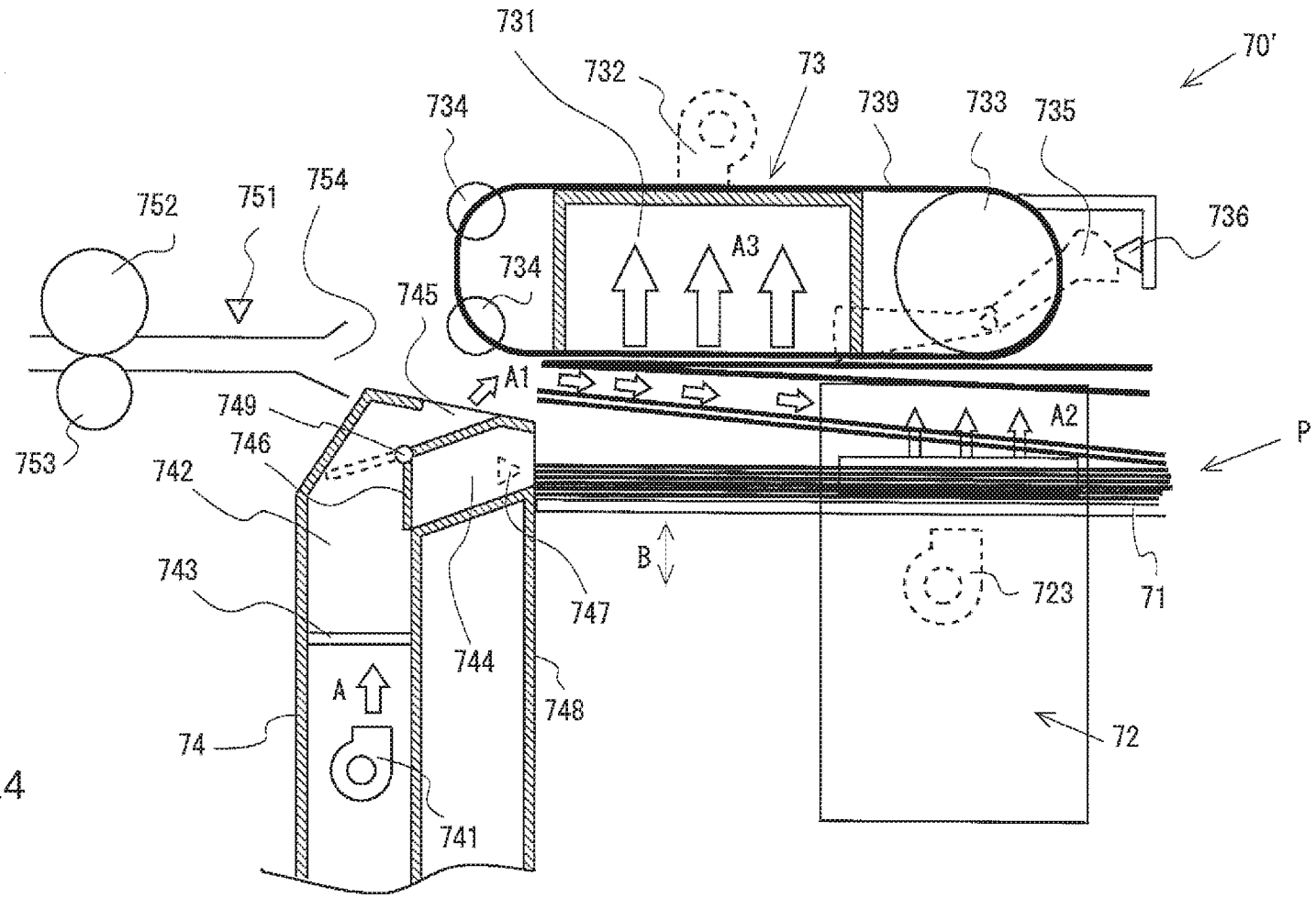
FIG. 14 is a side view for showing an example of operation when separation air A1 is blown against the leading edges of sheets P in the conventional paper feed apparatus 70'.
Figure 15:
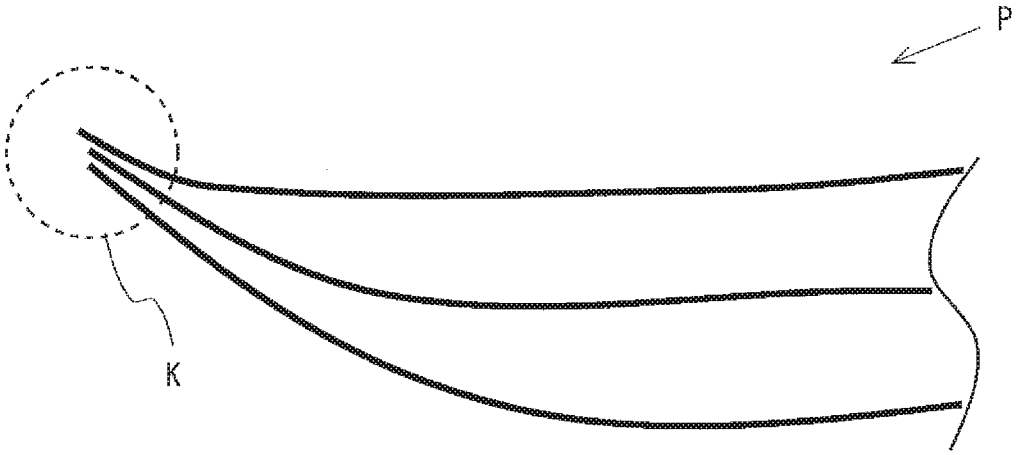
FIG. 15 is a schematic view for explaining the condition of the leading edges of sheets P when separation air A1 is blown against the leading edges of sheets P in the conventional paper feed apparatus 70'.

Next, the above structure is compared with a prior art example. FIG. 13 is a side view for showing an example of operation when lifting air A4 is blown against the leading edges of sheets P in a conventional paper feed apparatus 70'. FIG. 14 is a side view for showing an example of operation when separation air A1 is blown against the leading edges of sheets P in the conventional paper feed apparatus 70'. FIG. 15 is a schematic view for explaining the condition of the leading edges of sheets P when separation air A1 is blown against the leading edges of sheets P in the conventional paper feed apparatus 70'.

A blowing route 742 forms a guide route which is formed between the leading edge fan 741 and the lifting air outlet 744 and the separating air outlet 745. Accordingly, the blowing route 742 can guide air A supplied from the leading edge fan 741 to the lifting air outlet 744 or the separating air outlet 745. A tip shutter 743 is an openable/closable shutter which is located in the blowing route 742. A shunt member 746 is pivotally provided about a support shaft 749 to switch the flow direction of air A, which is supplied through the blowing route 742 by the leading edge fan 741, toward either one of the lifting air outlet 744 and the separating air outlet 745.

Accordingly, the shunt member 746 can freely change the flow direction of air A ejected by the leading edge fan 741. For example, when the shunt member 746 blocks air A flowing from the blowing route 742 to the separating air outlet 745, the air A ejected by the leading edge fan 741 is blown through the lifting air outlet 744 against the leading edges of sheets P. The lifting air A4 ejected from the lifting air outlet 744 is blown against the leading edges of sheets P approximately in the horizontal direction. On the other hand, when the shunt member 746 blocks air A flowing from the blowing route 742 to the lifting air outlet 744, the air A ejected by the leading edge fan 741 is blown through the separating air outlet 745 against the conveyor belt 739. The separation air A1 ejected from the separating air outlet 745 is blown against the conveyor belt 739 and flows along the conveyor belt 739. Namely, the separation air A1 is blown toward the attraction fan 732.

As shown in FIG. 13, sheets P is lifted up by blowing lifting air A4 to make the leading edges of the sheets P go up. In this case, a sheet P having been attracted onto the sheet attractor 73 may be accompanied with the next sheet P having a leading edge thereof which is in contact with the attracted sheet P. In such a case, if the next sheet P is in contact with the attracted sheet P as illustrated in FIG. 14, little gap is formed between these sheets P so that separation air A1 hardly enter the gap. As a result, the separation air A1 flows below the next sheet P to urge the next sheet P against the attracted sheet P. These sheets P tend to be carried together. In other words, an overlapped sheet jam, i.e., an overlap feeding jam tends to occur. Incidentally, when sheets P are curled in a downward convex condition as illustrated in FIG. 15, separation air A1 hardly enters the leading portion K of the sheets P where the leading edges of the sheets P tend to make contact with each other so that an overlap feeding jam tends to occur.

From this fact, the lifting member 77 is provided to adjust the height of sheets P by supporting the tail side of the back of sheets P in order that the tail side of the sheets P is located nearer to the sheet attractor 73 than the leading side of the sheets P and that the sheets P is supported at such an angle as to form a space between the sheet attractor 73 and the tail side of the sheets P. Accordingly, irrespective of the type of sheets P, the space between the leading side of the sheets P and the sheet attractor 73 is greater than the space between the tail side of the sheets P and the sheet attractor 73 so that the sheet attractor 73 can attract the sheets P from the tail side thereof. When an uppermost sheet is attracted onto the sheet attractor 73, little attracting force is exerted on the lower sheets. When blowing separation air A1 in this condition, the separation air A1 is blown against lower sheets and tends to enter between the uppermost sheet and the lower sheets so that the lower sheets can easily be separated from the uppermost sheet by the separation air A1. In other words, since sheets P is inclined with the lifting member 77, separation air A1 includes a component which is blown against the upper surfaces of the sheets P. Accordingly, even if there are an increased number of types of sheets P which are fed, it is possible to avoid failure in separating the sheets P.

Incidentally, the uppermost sheet is the sheet P located closest to the sheet attractor 73, and the lower sheets are sheets P located below the uppermost sheet. For example, when conveying the first sheet P from the above, this first sheet P is the uppermost sheet, and all the second and subsequent sheets P are lower sheets. Since the paper feed apparatus 70 conveys sheets P one by one from the above, when the second sheet is conveyed after conveying the first sheet, this second sheet then become a next uppermost sheet, and all the third and subsequent sheets become lower sheets.

Also, since the attraction force of the attraction fan 732 is set to be stronger than the separation force of the leading edge fan 741 for separating sheets P, the uppermost sheet, i.e., the first sheet P is attracted by the sheet attractor 73. When the first sheet P is attracted onto the sheet attractor 73, no attraction force is exerted on the lower sheets, i.e., the second and subsequent sheets so that the separation force is stronger than the attraction force. Accordingly, the second and subsequent sheets P can be separated from the first sheet P.

Also, the blowing direction of separation air A1 is controlled in the same direction from the start of conveying a sheet P until the end so that the separation force for separating sheets P is continuously provided. It is therefore possible to facilitate separation of lower sheets from the uppermost sheet.

Furthermore, since the blowing quantity of the separation air A1 is determined based on the type and size of a sheet P, separation air A1 can be supplied to the leading edges of sheets P without excess or deficiency. It is therefore possible to keep the flowing balance among separation air A1, side air A2 and attraction air A3 in the paper feed unit 2.

Since separation air A1 is blown against sheets P while conveying a sheet P, the leading edges of the sheets P can be prevented from being lifted. As a result, the sheet attractor 73 can attract sheets P from the tail edges thereof. Accordingly, the second and subsequent sheets P can be separated from the first sheet P.

Embodiment 2

Figure 4:
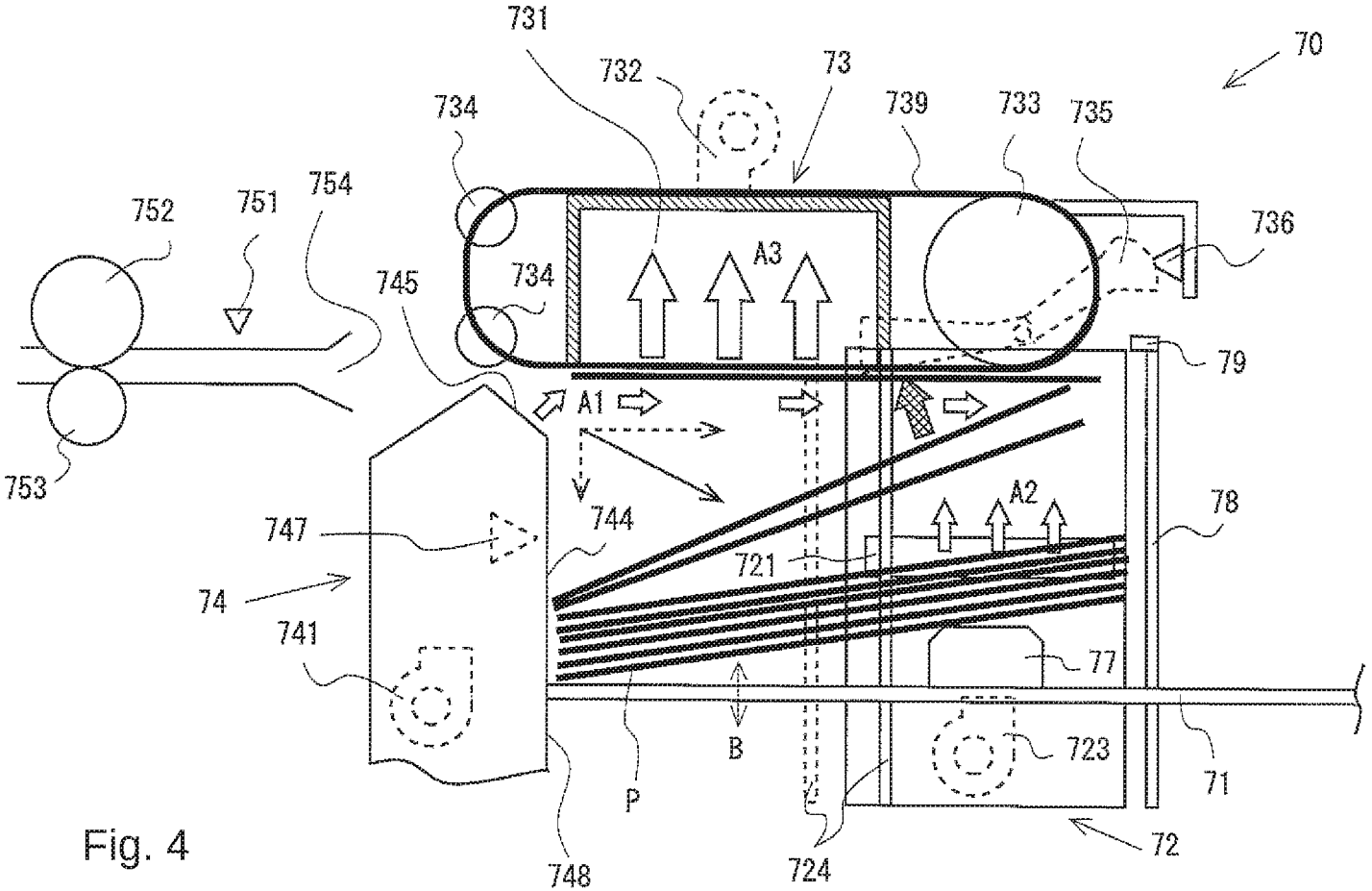
FIG. 4 is a side view for showing an exemplary structure of the paper feed apparatus 70 in accordance with an embodiment 2 of the present invention.
Figure 5:
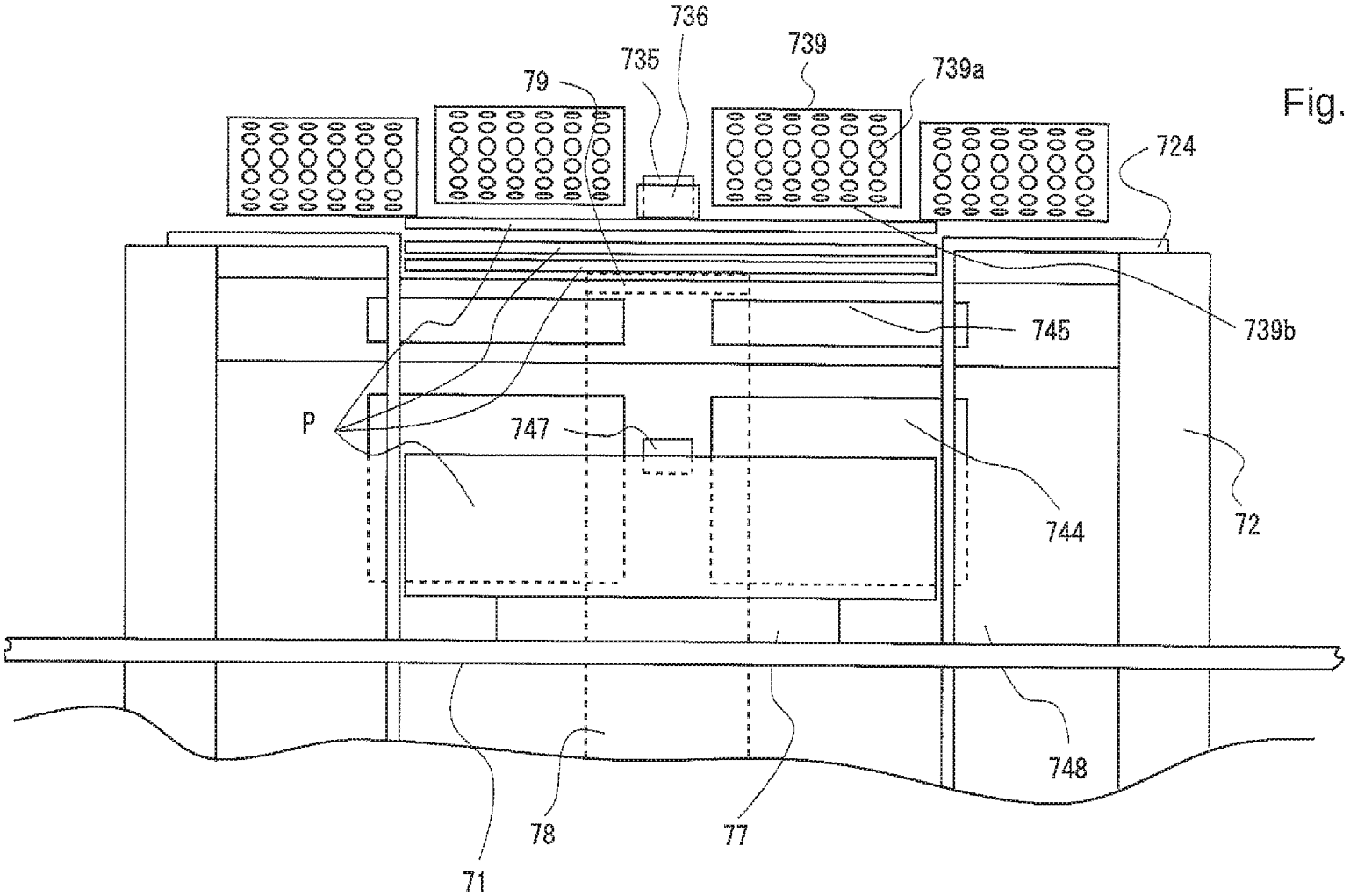
FIG. 5 is a front view for showing an exemplary structure of the paper feed apparatus 70 in accordance with the embodiment 2 of the present invention.
Figure 6:
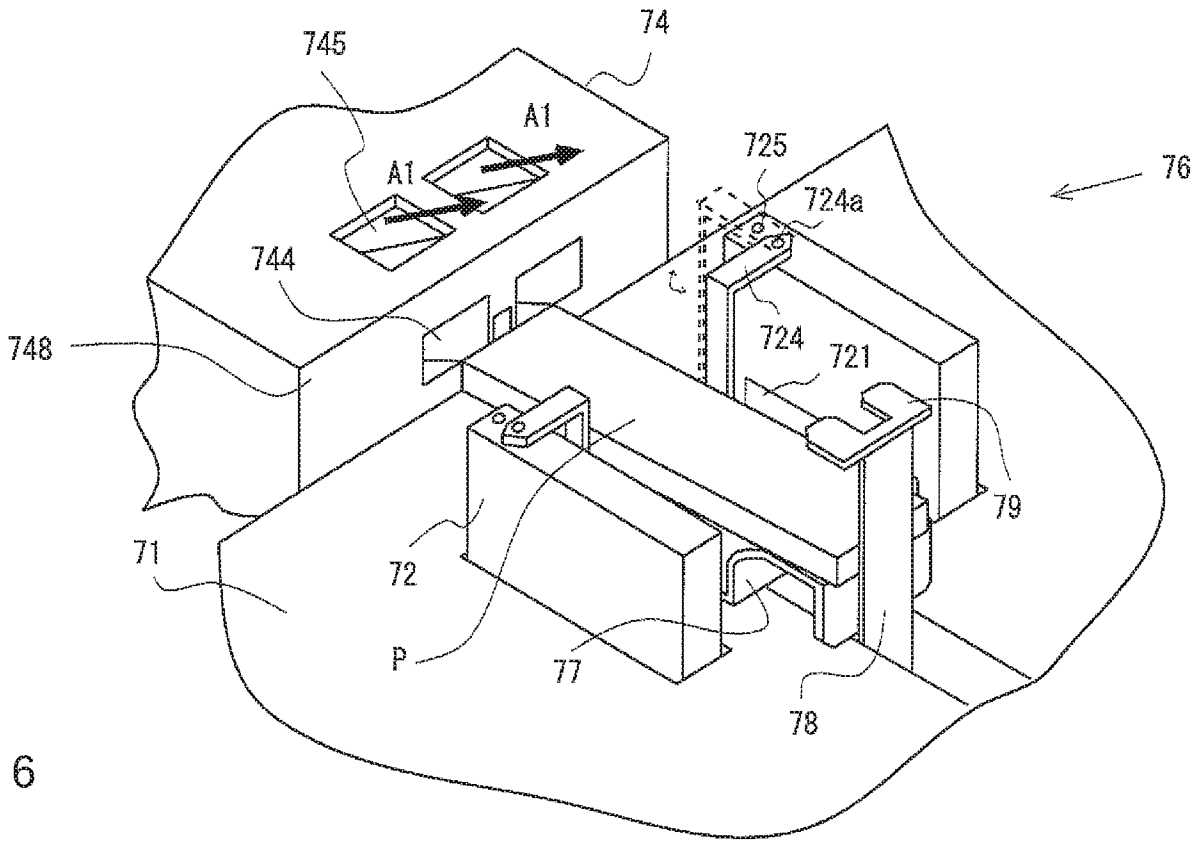
FIG. 6 is a perspective view for showing an exemplary structure of a sheet storage unit 76 in accordance with the embodiment 2 of the present invention.

In this embodiment 2, similar elements are given similar references as in the embodiment 1, and therefore no redundant description is repeated. The embodiment 2 is different from the embodiment 1 in that auxiliary side guides 724, a tail edge guide 78 and a regulation member 79 are provided. FIG. 4 is a side view for showing an exemplary structure of the paper feed apparatus 70 in accordance with the embodiment 2 of the present invention. FIG. 5 is a front view for showing an exemplary structure of the paper feed apparatus 70 in accordance with the embodiment 2 of the present invention. FIG. 6 is a perspective view for showing an exemplary structure of the sheet storage unit 76 in accordance with the embodiment 2 of the present invention.

The conveyor belt 739 consists of an endless belt through which a plurality of through holes 739*a* are formed. The through holes 739*a* are formed along the width direction of the conveyor belt 739 at a constant pitch. These through holes 739*a* are formed throughout the entirety of the conveyor belt 739 along the longitudinal direction perpendicular to the width direction of the conveyor belt 739. The surface of the conveyor belt 739 opposite to the sheet tray 71 is an attraction surface 739*b* onto which a sheet P is attracted. Incidentally, a plurality of the conveyor belts 739 are provided in parallel.

The side air opening 721 is formed below the attraction surface 739*b* in a position corresponding to the tail side of sheets P. The detection member 735 is provided between the conveyor belts 739, and lifted when a sheet P is attracted onto the attraction surface 739*b*. The attraction detection sensor 736 is implemented with a photo sensor which consists of a light receiving device and a light emitting device for detecting a change in the position of the detection member 735. The auxiliary side guide 724 is provided on the side guide 72 The auxiliary side guide 724 can freely be projected by rotating in the side direction of sheets P around an auxiliary side guide shaft 724*a*. By this configuration, it is possible to hold sheets P such as envelopes having a narrower width than sheets P which can be held with the side guide 72. An auxiliary side guide sensor 725 is provided on the top of the side guide 72. The auxiliary side guide sensor 725 determines whether or not the auxiliary side guide 724 is projected in the moving direction of the side guide 72. The auxiliary side guide sensor 725 can be implemented, for example, with an optical device or a switch.

Figure 7:
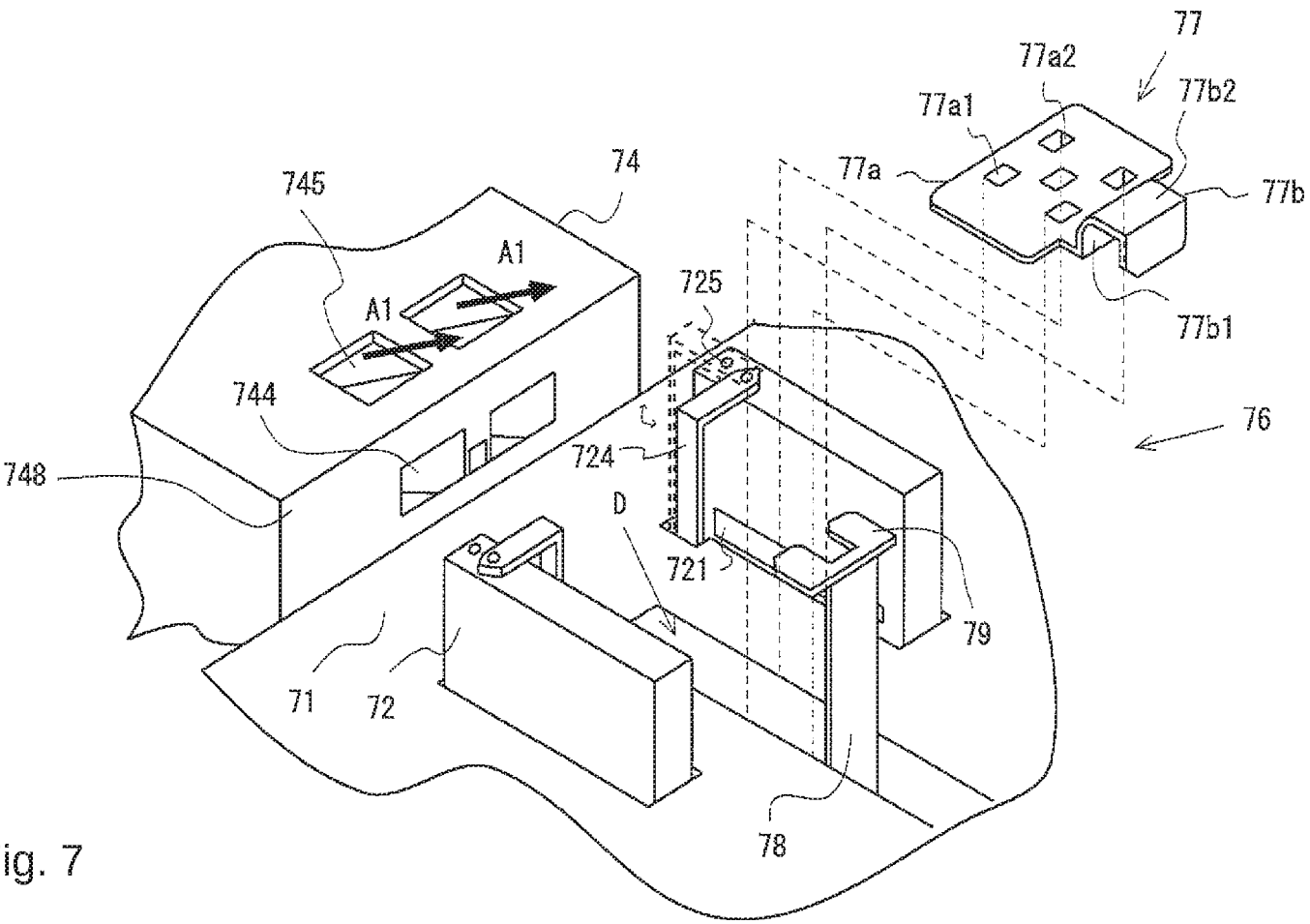
FIG. 7 is a perspective view for showing an exemplary structure of a lifting member 77 and an example of an attachable area D provided in a sheet tray 71 in accordance with the embodiment 2 of the present invention.
Figure 8:
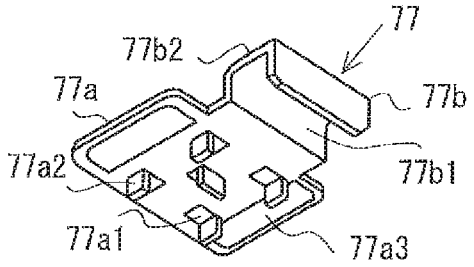
FIG. 8 is a perspective view for showing an exemplary structure of the lifting member 77 as viewed from a bottom side in accordance with the embodiment 2 of the present invention.
Figure 9:
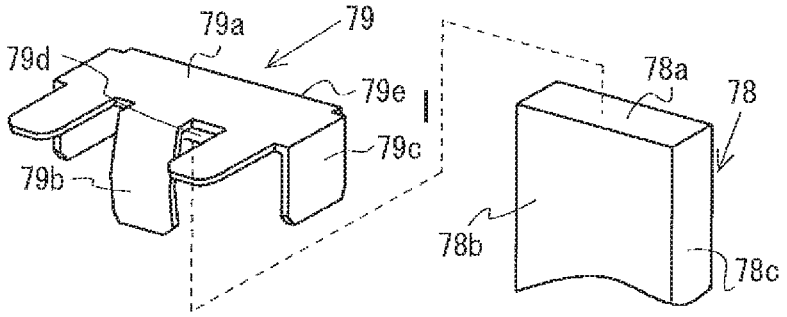
FIG. 9 is a perspective view for showing exemplary structures of a tail edge guide 78 and a regulation member 79 in accordance with the embodiment 2 of the present invention.
Figure 10:
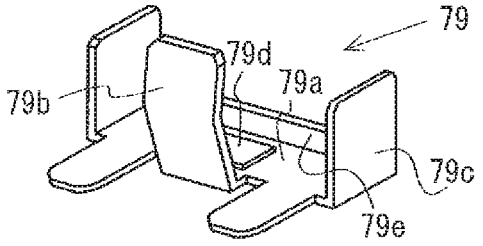
FIG. 10 is a perspective view for showing an exemplary structure of a regulation member 79 as viewed from a bottom side in accordance with the embodiment 2 of the present invention.

FIG. 7 is a perspective view for showing an exemplary structure of the lifting member 77 and an example of an attachable area D provided in the sheet tray 71 in accordance with the embodiment 2 of the present invention. FIG. 8 is a perspective view for showing an exemplary structure of the lifting member 77 as viewed from a bottom side in accordance with the embodiment 2 of the present invention. FIG. 9 is a perspective view for showing exemplary structures of the tail edge guide 78 and the regulation member 79 in accordance with the embodiment 2 of the present invention. FIG. 10 is a perspective view for showing an exemplary structure of the regulation member 79 as viewed from a bottom side in accordance with the embodiment 2 of the present invention.

The paper feed apparatus 70 is provided with the tail edge guide 78 and the regulation member 79. The tail edge guide 78 guides the tail edges of sheets P. The regulation member 79 is detachably provided on the upper end portion 78*a* of the tail edge guide 78 to regulate the upper limit of the allowable range of the height of sheets P. Specifically, the tail edge guide 78 includes the upper end portion 78*a*, a sheet facing surface 78*b* and a width direction determination surface 78*c*. The regulation member 79 is provided with an upper limit regulation section 79*a*, a front side fixation section 79*b*, a pair of lateral side fixation sections 79*c*, a magnet catch 79*d* and a back side fixation section 79*e*. The upper limit regulation section 79*a* is a member which determines the upper limit of the height of sheets P which can be stacked on the sheet tray 71. The front side fixation section 79*b* is a member which determines the front side arrangement position of the regulation member 79. The lateral side fixation sections 79*c* are members which determine the lateral side arrangement position of the regulation member 79. The magnet catch 79*d* is a member with which the regulation member 79 is attracted onto the tail edge guide 78. The back back fixation section 79*e* is a member which determines the back side arrangement position of the regulation member 79.

The lifting member 77 is provided with a fixation member 77*a* and a support member 77*b*. The fixation member 77*a* is a member which is detachably mounted on the attachable area D of the sheet tray 71 to fix the lifting member 77 to a mounting position in the attachable area D. The attachable area D corresponds, for example, to an area defined by the width and longitudinal length of a groove formed through the sheet tray 71. The support member 77*b* is formed to rise from the fixation member 77*a*, and serves as a member which supports the back of sheets P.

Specifically, the fixation member 77*a* is formed with openings 77*a*1. The openings 77*a*1 are associated with hooks 77*a*2 respectively. Magnet sheets 77*a*3 are provided on the bottom surface of the fixation member 77*a*. The hooks 77*a*2 determine the positional relationship between the lifting member 77 and the edge of the groove of the attachable area D, and the attracting force of the magnet sheets 77*a*3 is exerted to fix the positional relationship between the lifting member 77 and the edge of the groove of the attachable area D. The support member 77*b* includes a rising section 77*b*1 and a support section 77*b*2. The rising section 77*b*1 is a section which determines the height to which the tail side of the back of sheets P is lifted by the lifting member 77. The support section 77*b*2 is a section which incorporates a surface which makes contact with the tail side of the back of sheets P.

As has been discussed above, in accordance with the present embodiment, the side air opening 721 is formed below the attraction surface 739*b* in a position corresponding to the tail side of sheets P. Furthermore, the tail side of sheets P is held in an upper position by the lifting member 77. Accordingly, even when an attraction force is exerted on sheets P by the attraction fan 732, the sheets P is lifted from the tail side of sheets P without flapping by side air A2 which is blown against the lateral side of the sheets P through the side air opening 721. Hence, since sheets P can be attracted by the sheet attractor 73 not from the leading side of the sheets P but from the tail side of the sheets P, the leading edges of the uppermost sheet and lower sheets are inhibited from approaching each other.

Also, in the case of the present embodiment, since a regulation member 79 regulates the upper limit of the allowable range of the height of sheets P, sheets P can be stacked on the sheet tray 71 until the regulation member 79 is reached. Accordingly, since it becomes clear what number of sheets P can be processed in one job, it is possible to avoid a jam which is caused by excessively stacking sheets P on the sheet tray 71.

Also, in accordance with the present embodiment, while the lifting member 77 includes the fixation member 77*a* and the support member 77*b*, the profiles of the attachable area D and support member 77*b* are determined based on the type and size of sheets P. The lifting member 77 is thereby formed for each type and each size of sheets P. Also, the lifting member 77 is detachably provided, and the attachable area D is determined for each type and each size of sheets P. Accordingly, sheets P can easily be arranged in such a condition that the sheets P can easily be separated so that a variety of sheets P can be supported at a low cost.

Incidentally, a plurality of the sheet attractors 73 are parallelly arranged in a center arrangement position opposite to sheets P and lateral arrangement positions which are in the both sides of the center arrangement position. The height of the center arrangement position differs from the heights of the lateral arrangement positions. Accordingly, if sheets P are not wide enough to reach the lateral arrangement positions, the sheets P do not extend from the center arrangement position to the lateral arrangement positions so that the sheets P cannot be corrugated. Furthermore, even if sheets P are wide enough to reach the lateral arrangement positions, in the case where the stiffness of the sheets P is high such as cardboards, envelopes or the like, the sheets P cannot be corrugated.

However, even when sheets P are not corrugated as described above, separation air A1 can easily enter the leading edges of the sheets P by lifting the tail side of sheets P with the lifting member 77 so that the lower sheets can easily be separated from the uppermost sheet by the separation air A1. In other words, even in the case of using sheets P which are hardly separated by nature, for example, small sheets P which are hardly corrugated, sheets P having a high stiffness such as cardboards or envelopes, or the like, the lifting member 77 lifts the sheets P in such a position where the sheets P are easily separated so that it is possible to avoid failure in separating the sheets P.

Embodiment 3

In this embodiment 3, similar elements are given similar references as in the embodiments 1 and 2, and therefore no redundant description is repeated. The embodiment 3 partially differs from the embodiments 1 and 2 in the profile and function of the lifting member 77.

Figure 11:
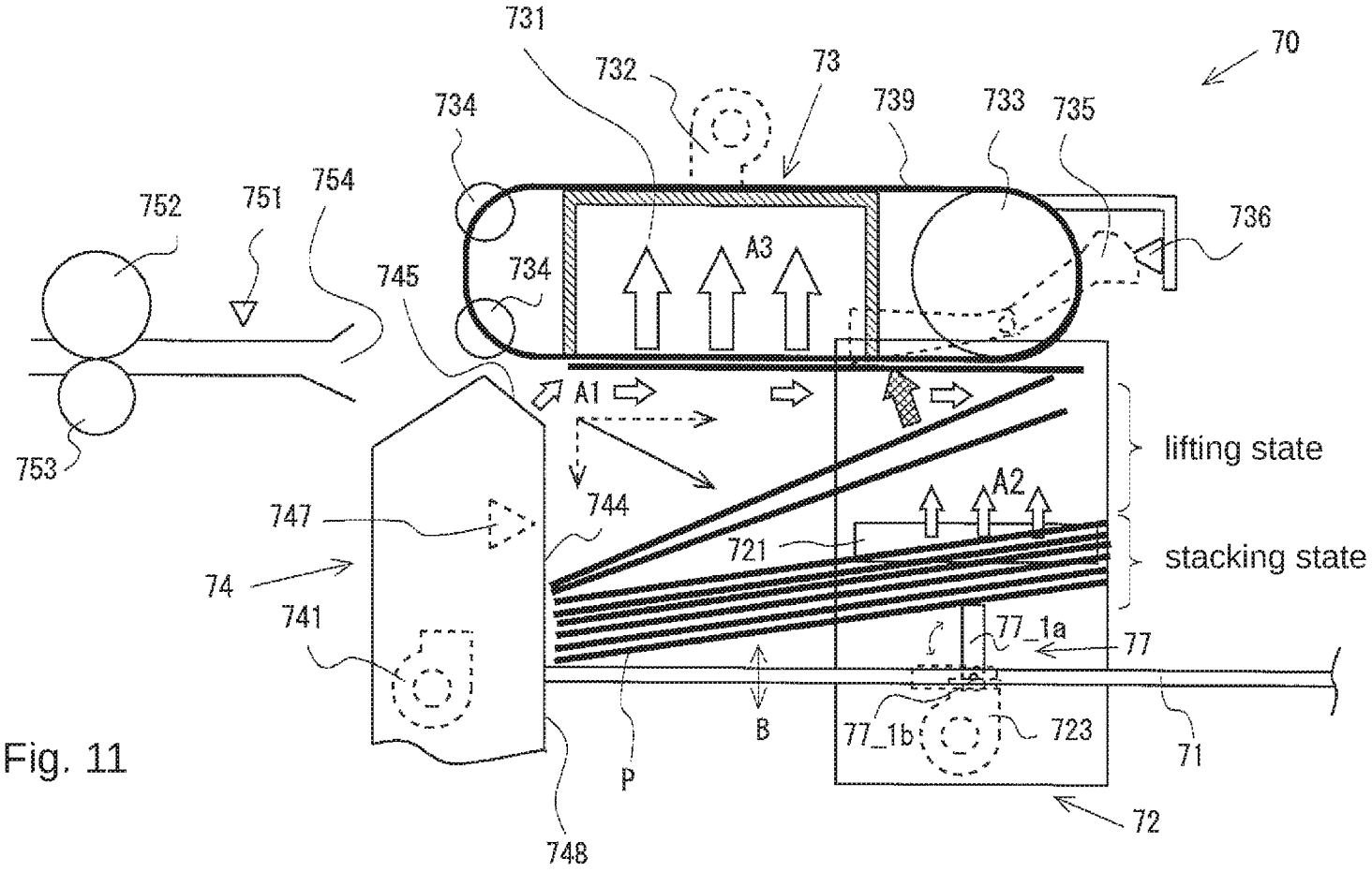
FIG. 11 is a side view for showing an exemplary structure of the paper feed apparatus 70 in accordance with an embodiment 3 of the present invention.

FIG. 11 is a side view for showing an exemplary structure of the paper feed apparatus 70 in accordance with the embodiment 3 of the present invention. The lifting member 77 is provided with a support member 77_1*a* and a rotation member 77_1*b*. The rotation member 77_1*b* is pivotally provided around a fulcrum which is a part of the sheet tray 71. The support member 77_1*a* is integrally formed with the rotation member 77_1*b*. The fulcrum in this case is located on the sheet tray 71 in correspondence with a position opposite to the tail side of sheets P. The support member 77_1*a* supports the back of sheets P when it rises from the sheet tray 71, but does not support the back of the sheets P when it does not rise from the sheet tray 71. Incidentally, the lifting member 77 having the support member 77_1*a* and the rotation member 77_1*b*, to be installed on the sheet tray 71, is provided in each of arrangement locations the number of which is determined based on the type and size of sheets P.

As described above, in accordance with the present embodiment, while the lifting member 77 includes the support member 77_1*a* and the rotation member 77_1*b*, the support member 77_1*a* takes either of two states, i.e., a state in which the support member 77_1*a* supports the back of sheets P and a state in which the support member 77_1*a* does not supports the back of sheets P, in accordance with whether or not the support member 77_1*a* rises from the sheet tray 71. Accordingly, it is possible to easily switch whether to lift sheets P for each type and each size of the sheets P. Furthermore, the lifting member 77 having the support member 77_1*a* and the rotation member 77_1*b*, to be installed on the sheet tray 71, is provided in each of arrangement locations the number of which is determined based on the type and size of sheets P, so that it is possible to select the lifting member 77 to rise in accordance with the sheets P. The lifting member 77 can thereby be selected to facilitate separation of sheets P, and can be adapted for a variety of sheets P at a low cost.

Embodiment 4

In this embodiment 4, similar elements are given similar references as in the embodiments 1 through 3, and therefore no redundant description is repeated. The embodiment 4 differs from the embodiments 1 through 3 in that the inclination of the sheet tray 71 can be adjusted.

Figure 12:
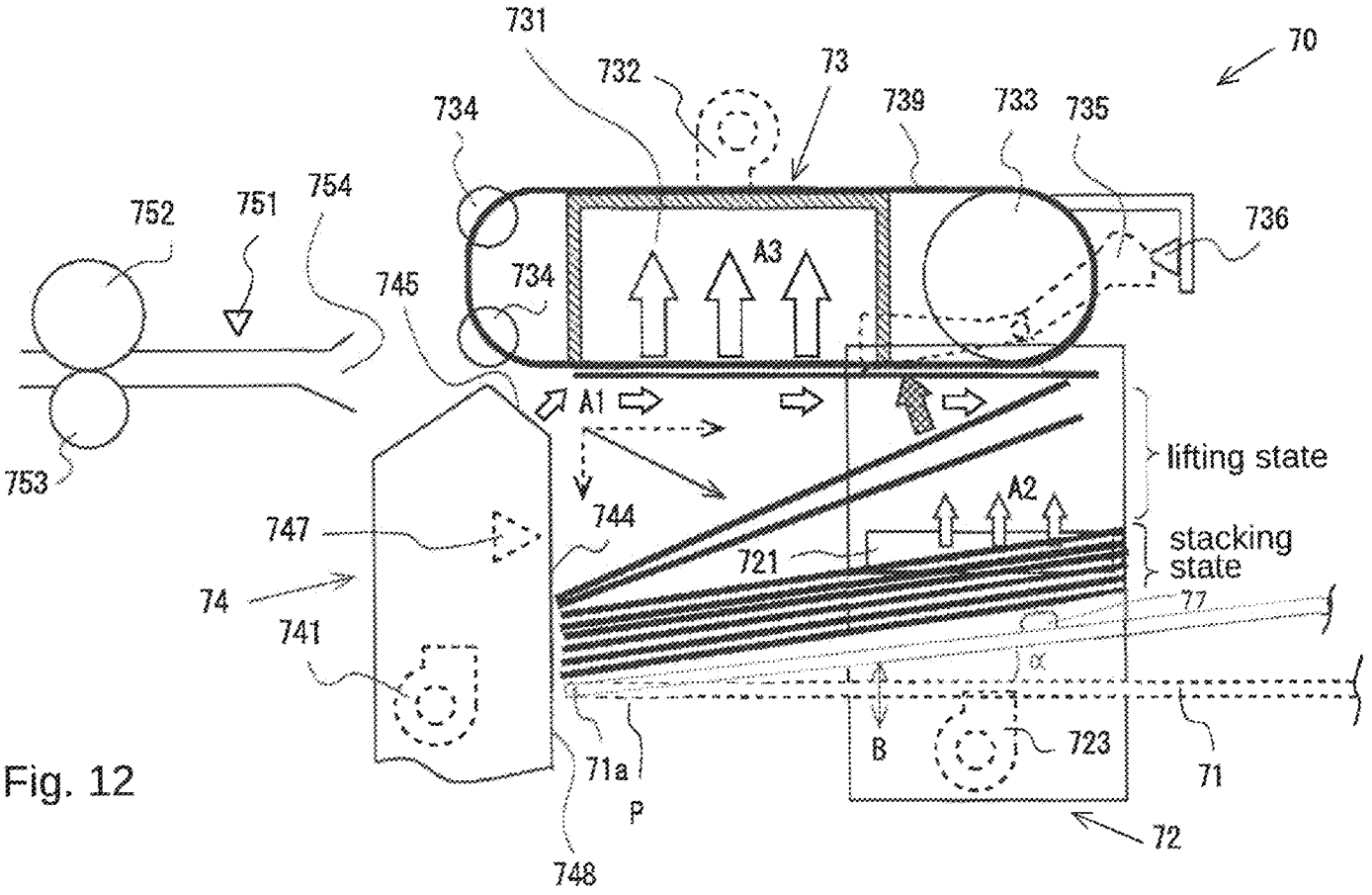
FIG. 12 is a side view for showing an exemplary structure of the paper feed apparatus 70 in accordance with an embodiment 4 of the present invention.

FIG. 12 is a side view for showing an exemplary structure of the paper feed apparatus 70 in accordance with the embodiment 4 of the present invention. The sheet tray 71 can be freely elevated and lowered along the side guide 72, and the inclination angle $\alpha$ of the sheet tray 71 can be freely adjusted around a rotation member 71*a* as a fulcrum located opposite to the leading edges of sheets P. The inclination angle $\alpha$ is determined based on the type and size of sheets P.

As described above, in the case of the present embodiment, the height to which sheets P is lifted can be set for each type and each size of sheets P only by adjusting the inclination of the sheet tray 71. Accordingly, it is possible to easily adapt the configuration for a variety of sheets P.

The image forming unit 1 have been explained based on the embodiments in accordance with the present invention. However, it is not intended to limit the present invention to the precise form described, and obviously many modifications and variations are possible without departing from the spirit and scope of the invention. For example, while the image forming unit 1 of the present embodiment is provided with the paper feed unit 2 and the image forming apparatus 3, the present invention is not limited thereto. For example, the image forming unit 1 may be provided with an image reading apparatus, a relay device, a finisher or the like. Furthermore, in the case of the present embodiments, it is possible to combine parts of the embodiments 1 to 4 or a plurality of the embodiments 1 to 4.

Although embodiments of the present invention have been described and illustrated in detail, it is clearly understood that the same is by way of illustration and example only and not limitation, the scope of the present invention should be interpreted by terms of the appended claims.

What is claimed is:

1. A paper feed apparatus comprising:

a sheet tray having a surface on which sheets are stacked, wherein at least a front of a bottommost one of the sheets contacts the surface of the sheet tray when the sheets are stacked on the sheet tray;

a sheet attractor which is located above the sheet tray and attracts sheets one by one from the above;

a leading edge fan which is located in a leading edge side of the sheets and blows separation air against leading edges of the sheets to separate an uppermost sheet of the sheets closest to the sheet attractor from lower sheets located below the uppermost sheet;

a sheet conveyor which is located in a downstream side of the sheet attractor along a conveying direction of the sheets to convey the uppermost sheet which is attracted by the sheet attractor and separated from the lower sheets by the leading edge fan; and a lifting member which is detachably provided on the surface of the sheet tray to support a tail side of a back of the sheets, the lifting member having a fixation member and a support member, the fixation member detachably formed on an attachable area on the surface of the sheet tray and the support member being connected at a back side of the fixation member and formed to rise from the fixation member to support the tail side of the back of the sheets above the surface of the sheet tray.

2. The paper feed apparatus of claim 1 further comprising an attraction fan which provides a negative pressure in the sheet attractor, wherein an attraction force of the attraction fan is set to be stronger than a separation force of the leading edge fan for separating lower sheets from the uppermost sheet at least until the uppermost sheet is attracted by the sheet attractor.

3. The paper feed apparatus of claim 2 wherein a blowing direction of the separation air is continuously supplied in the same direction from the start of conveying the uppermost sheet to the sheet conveyor until an end.

4. The paper feed apparatus of claim 3 further comprising:

a control unit configured to determine a blowing quantity of the separation air based on a type and a size of the sheets.

5. The paper feed apparatus of claim 4 further comprising:

a side guide which is located in the lateral side of the sheets to guide a side of the sheets;

a side air opening which is formed in the side guide to blow side air against the side of the sheets, wherein the sheet attractor is provided with a conveyor belt through which a plurality of through holes are formed to attract the sheets by the attraction fan through the plurality of through holes, wherein the conveyor belt has an attraction surface onto which the sheets are attracted through the plurality of through holes, wherein the side air opening is formed below the attraction surface in a position corresponding to the tail side of the sheets.

6. The paper feed apparatus of claim 5 wherein while a sheet is conveyed from the sheet tray to the sheet conveyor, the leading edge fan continuously blows the separation air.

7. The paper feed apparatus of claim 6 further comprising:

a tail edge guide which guides tail edges of sheets; and a regulation member which is detachably provided on an upper end portion of the tail edge guide to regulate an upper limit of an allowable range of the height of sheets.

8. The paper feed apparatus of claim 7 wherein the sheet tray can be freely elevated and lowered along the side guide and the tail edge guide, wherein profiles of the support member are determined based on the type and size of sheets.

9. The paper feed apparatus of claim 7 wherein the sheet tray can be freely elevated and lowered along the side guide, and the inclination angle of the sheet tray can be freely adjusted around a fulcrum located below the leading edges of sheets, and wherein the inclination angle is determined based on the type and size of the sheets P.

10. A paper feed unit comprising a plurality of paper feed apparatuses as recited in claim 8.

11. The paper feed apparatus of claim 1 wherein the sheet tray can be freely elevated and lowered along the side guide, and profiles of the support member are determined based on the type and size of sheets.

12. The paper feed apparatus of claim 1, wherein the fixation member of the lifting member includes holes and hooks, each of the hooks being associated with a respective one of the holes, wherein the hooks determine a positional relationship between the lifting member and the attachable area in the sheet tray.

13. The paper feed apparatus of claim 1, wherein the support member of the lifting member is disposed on a tail end side of the attachment member.

* * * * *